United States Patent [19]

Ulyanitsky et al.

[11] Patent Number: 5,004,021

[45] Date of Patent: Apr. 2, 1991

[54] ARRANGEMENT FOR CONVEYING POWDER TO THE BARREL OF A GAS DETONATION APPARATUS

[76] Inventors: Vladmir J. Ulyanitsky; Tamara P. Gavrilenko; Jury A. Nikolaev; Alexandr I. Buteev, all of Novosibirsk, U.S.S.R.

[73] Assignee: Institut Gidvodinamiki Imeni M.A. Lavrentieva Sibirskogo Otdelenia Akademii Nauk S.S.S.R., Novosibirsk, U.S.S.R.

[21] Appl. No.: 415,369

[22] PCT Filed: Jan. 18, 1989

[86] PCT No.: PCT/SU89/00008

§ 371 Date: Sep. 18, 1989

§ 102(e) Date: Sep. 18, 1989

[87] PCT Pub. No.: WO89/06570

PCT Pub. Date: Jul. 27, 1989

[30] Foreign Application Priority Data

Jan. 19, 1988 [SU] U.S.S.R. ..... 4409712

[51] Int. Cl.[5] ..... B65B 1/08; B67D 5/00

[52] U.S. Cl. ..... 141/67; 141/249; 222/636; 128/203.15

[58] Field of Search ..... 141/67, 249, 116, 260; 222/636, 637, 361; 406/74, 73, 67, 63; 128/203.15; 604/58

[56] References Cited

U.S. PATENT DOCUMENTS

| | | | |
|---|---|---|---|
| 1,528,022 | 3/1925 | Keiser | 222/636 |
| 2,587,215 | 2/1952 | Priestly | 128/203.15 |
| 3,797,709 | 3/1974 | Ivanovich | 222/194 |
| 4,184,258 | 1/1980 | Barrington et al. | 222/636 |
| 4,747,524 | 5/1988 | Krambrock | 222/636 |
| 4,751,948 | 6/1988 | Hertig et al. | 141/67 |

FOREIGN PATENT DOCUMENTS

| | | |
|---|---|---|
| 577947 | 10/1977 | U.S.S.R. . |
| 764735 | 9/1980 | U.S.S.R. . |
| 952360 | 8/1982 | U.S.S.R. . |
| 985712 | 1/1983 | U.S.S.R. . |
| 1068537 | 1/1984 | U.S.S.R. . |

*Primary Examiner*—Henry J. Recla
*Assistant Examiner*—Keith Kupferschmid
*Attorney, Agent, or Firm*—Fleit, Jacobson, Cohn, Price, Holman & Stern

[57] ABSTRACT

The arrangement comprises a housing (1), a hopper (2) containing a powder and communicating with the interior of the housing (1), and a slide valve (11) having a drive (9) mounted inside the housing (1) and provided with a powder-metering cavity in the form of a recess (12).

The housing has through passages for feeding compressed gas, and conveying the powder from the hopper (2) to the recess (12) and from the recess to the barrel. The slide value (11) is arranged at the top part of the housing (1) and resiliently urged thereto in the zone of outlet holes of the passages. The arrangement also has a shut-off unit (18) connected to the slide valve (11) to block the outlet hole (8) of the passage for feeding the powder from the recess (12) to the barrel in one of extreme positions of the slide valve (11), in the other extreme position thereof the powder-metering cavity (12) communicates with the outlet hole (8) of the passage conveying the powder to the barrel.

3 Claims, 2 Drawing Sheets

ARRANGEMENT FOR CONVEYING POWDER TO THE BARREL OF A GAS DETONATION APPARATUS

FIELD OF THE INVENTION

This invention relates generally to apparatus for applying powder coatings to workpieces, and more particularly it concerns an arrangement for conveying powder to the barrel of a gas detonation apparatus.

The invention can be utilized with the utmost advantage for obtaining refractory, corrosion- and wear-resistant coatings by gas detonation to protect units and parts of machines and mechanisms operating in highly corrosive media against intensive abrasive wear.

BACKGROUND OF THE INVENTION

The essence of applying coatings by gas detonation rests in the following. A barrel open at one end is filled with an explosive gaseous mixture, a powder for obtaining a coating is fed, and detonation is initiated at the closed end of the barrel. The high-temperature (~4000° C.) and high-speed (~1500 m/s) flow of detonation products heats and accelerates the powder particles which are thrown against the surface of a workpiece before the open end of the barrel to form a coating. Normally, the apparatus for applying coatings by gas detonation are automatically controlled, the detonation process being repeated at a frequency of about 10 shots per second.

One of the major units of the gas detonation apparatus is an arrangement for conveying a powder material to the barrel. This arrangement is intended to convey a preset quantity of powder to a preset section of the barrel at a preset point in time. The more accurately such conditions are conformed to the higher is the quality of coatings, expressed by such characteristics as stability of the coating, strong bond between the coating and the surface of the workpiece, porosity, and thickness of the coating after one shot.

Among factors complicating normal functioning of such arrangements in apparatuses for applying coatings by gas detonation are the following: penetration of the products of detonation from the barrel to the housing of the powder-feeding arrangement (backfire) and penetration of the explosive mixture to the housing of the arrangement as this mixture is fed to the barrel of the apparatus. These two factors can lead to failure of the apparatus.

Therefore, the arrangement for conveying powder to the barrel should be so constructed as ensure an extra service life, stable cyclical feeding of the powder with particle size of 5 to 50 mkm (at a frequency of 1 to 10 cycles per second), an accurately preset quantity of powder for each cycle, reliable protection of the arrangement against backfires, uniform distribution of the powder particles in the flow of detonation products, fluidity of the powder as it fills the powder-metering recess, amenability to automatic remote control over the quantities of powder and carrier gas, and provision for minimizing the quantity of powder-carrying gas entering the barrel.

At present, apparatuses for applying coatings by gas detonation use two types of powder feeding arrangements, particularly pneumatic and mechanical. In the pneumatic arrangements powder is conveyed to the barrel of the apparatus by a compressed gas continuously or in a pulse-wise manner. In the continuous feeding of the powder to the barrel the quantity of powder is spread in the barrel in the form of an elongated mist. In this case the difference in the initial position of the powder particles axially of the barrel leads to variations in the speed and heating temperature of the particles as they are accelerated and heated by detonation products in the barrel of the apparatus. Experiments have shown that for obtaining high-quality coatings from a preselected powder material it is necessary that during the escape of the powder particles from the barrel the speed and temperature of all the particles of the quantity of powder fed to the barrel be approximately equal. This condition cannot be complied with during continuous feeding of the powder to the barrel, and therefore continuous feeding of the powder to the barrel results in low quality coatings with unstable characteristics.

During pulsewise feeding of the powder to the barrel in agreement with the working cycle of the apparatus the metered quantity of powder is localized in a small volume in the zone where the powder is introduced to the barrel, whereby a negligeable spread in the speed and temperature of powder particles at the outlet from the barrel and near the surface being coated is ensured. The pulsewise feeding of powder to the barrel allows to control the process of coating application.

The quantity of powder fed to the barrel is preset in various manners, such as by the diameter of pipe carrying the powder, or by the depth to which a rod with a powder-metering recess is immersed in a hopper filled with the powder. An inherent disadvantage of such powder metering arrangement rests in variations (to tens of percent) in the quantity of powder introduced to the barrel because of low fluidity of the powder or a change in the volume of the powder metering device due to abrasive wear of the metering recess eventually resulting in unstanble characteristics of coatings.

The known powder feeding arrangements lack means for protecting against backfires propagating through the powder-conveying gas pipes. In order to prevent the action of backfires, the pipes carrying the powder are elongated which leads to delays in power supply, i.e., a slower response of the arrangement.

An arrangement bearing the closest resemblance to one to be described in the present invention includes a pressure-sealed cylindrical housing accomodating a piston valve driven by compressed gas.

The housing comprises a hopper containing a powder and communicating with the interior of the housing, and a slide valve provided with a powder-metering recess and a drive, the housing having through passages for conveying the powder from the hopper to the powder-metering recess, for feeding a compressed gas and for conveying the powder from the powder-metering recess to the barrel. The powder-metering recess is provided in the slide valve and arranged so that in one of its extreme positions it communicates with the hopper where it is charged with the powder, whereas in the other extreme position it communicates with holes for feeding the powder to the barrel and for feeding the compressed gas carrying the powder from the powder-metering recess to the barrel. In this construction of the arrangement the quantity of powder fed to the barrel is preset by the volume of the powder-metering recess, whereas the piston valve protects the powder-metering device against backfires, as the hole through which the powder is fed to the barrel is closed by the piston valve during detonation.

However, with this construction of the powder-metering device the clearance between the containing surface of the piston valve and housing is susceptible to penetration therein of the powder fed to the barrel to result in possible jamming of the slide valve and failure of the powder-metering device. Also, penetration of the powder to the clearance between the slide valve and housing results in fast wear of contacting surfaces and reduces the quantity of powder fed to the barrel. For this reason, losses of powder can be as high as 30–40% of the powder quantity determined by the powder-metering recess resulting in unstable thickness of the coating applied by one shot.

SUMMARY OF THE INVENTION

The present invention aims at providing such an apparatus for conveying powder to the barrel of a gas detonation apparatus which would obviate jamming and wear of a slide valve as the powder penetrates into the clearance between the engaging surfaces of the slide valve and housing, while ensuring accurate and stable meter-feeding of the powder to the barrel.

The aims of the invention are attained by that in an arrangement for feeding powder to the barrel of a gas detonation apparatus comprising a housing, a hopper containing the powder and communicating with the interior of the housing, and a slide valve provided inside the housing and having a powder-metering recess and a drive, the housing having passages for feeding compressed air and for conveying the powder from the hopper to the powder-metering recess and from the powder-metering recess to the barrel, according to the invention, the slide valve is positioned at the upper part of the housing and resiliently urged thereto in the zone of outlet holes of the passages, the powder-metering recess being made at the surface of the slide valve in contact with the housing, a shut-off unit being further provided which is connected to the slide valve and which blocks the outlet hole of the passage for conveying the powder from the powder-metering recess to the barrel in one of the extreme positions of the slide valve, in the other extreme position of the slide valve the powder metering recess communicates with the outlet hole of the passage for conveying the powder to the barrel.

The proposed construction of the powder-metering device has a long service life, is reliebly protected against backfires, and ensures feeding a quantity of powder to a small volume of the barrel to eventually result in obtaining high-quality coatings with stable characteristics. This has been attained by arranging the slide valve at the top part of the powder-metering device, a substantial part of the surface of the slide valve being free from contact with the housing, and pressure of the slide valve at the side of the free surface preventing its jamming in the housing thereby ensuring operability and long service life of the arrangement. When powder penetrates into the clearance between the contacting surfaces of the housing and slide valve, the slide valve is caused to be displaced along a line normal to the surface of contect, whereby the powder leaves the clearance and falls to the bottom of the housing. Arranging the powder-metering device in the form of a recess ensures accurate metering of the powder and prevents leaks of the powder from the metering recess.

Protection or the powder metering device against backfire is ensured by the shut-off unit connected to the slide valve and drive. The shut-off unit moves in synchronism with the slide valve to reliably block the outlet hole of the passage for conveying the powder from the powder-metering recess to the barrel.

In a preferred embodiment of the invention an additional recess is provided at the surface of the slide valve in contact with the housing, the housing having a passage communicating the passage for feeding compressed gas through the additional recess with the interior of the hopper in one of the extreme positions of the slide valve. A quantity of compressed air acts to air-lift the powder material from the bottom of the hopper thereby preventing bridging of the powder.

In one alternative embodiment the shut-off unit has the form of a wedged connection.

This construction of the shut-off unit reliably protects the powder-metering device against backfire, and facilitates locking of the powder-metering recess under the outlet hole of the hopper.

Preferably, the slide valve has the form of a prism. This construction of the slide valve is the simplest.

BRIEF DESCRIPTION OF DRAWINGS

Other objects and attending advantages of the invention will become more fully apparent from a more detailed description thereof taken in conjunction with the accompanying drawings, in which.

BEST MODE OF CARRYING OUT THE INVENTION

The proposed apparatus comprises a pressure-sealed housing 1 (FIGS. 1 and 2) having mounted thereon a hopper 2 communicating with the interior of the housing 1 via a passage 3 made in a cover plate 3' of the housing 1.

Figure 1:
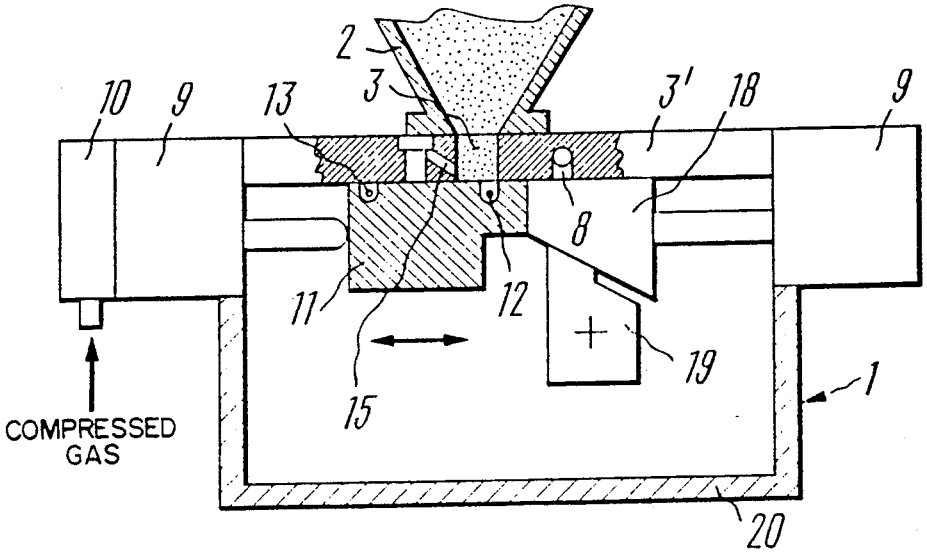
FIG. 1 is a longitudinal sectional view of the proposed arrangement in the extreme left-side position of the slide valve.
Figure 2:
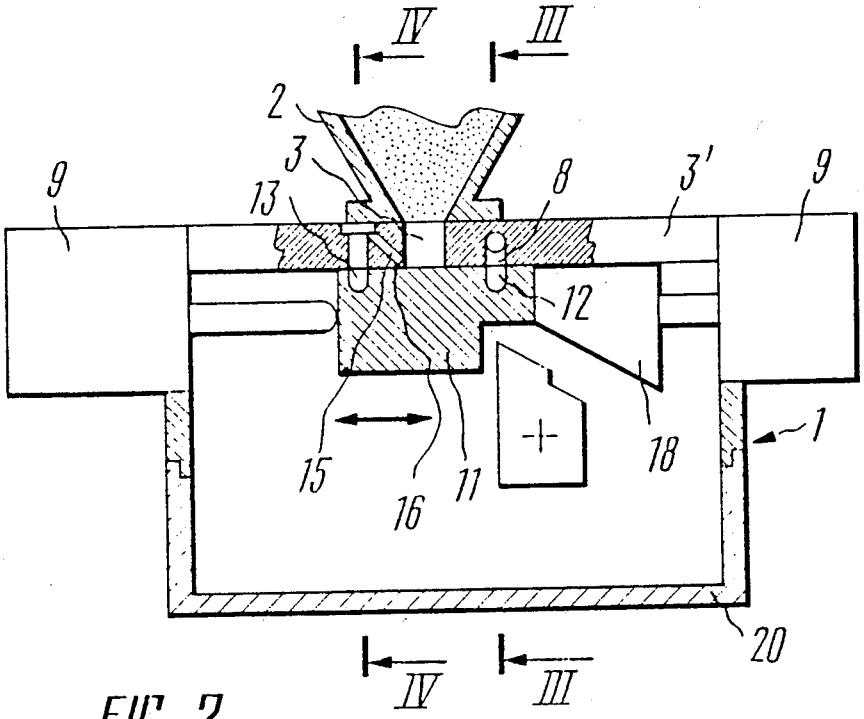
FIG. 2 shows the same in the extreme right-side position of the slide valve.
Figure 3:
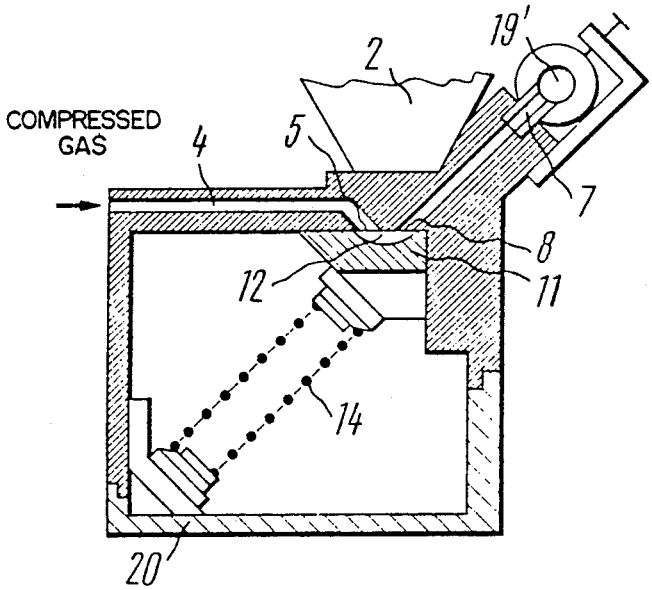
FIG. 3 is a section taken along the line III—III in FIG. 2.
Figure 4:
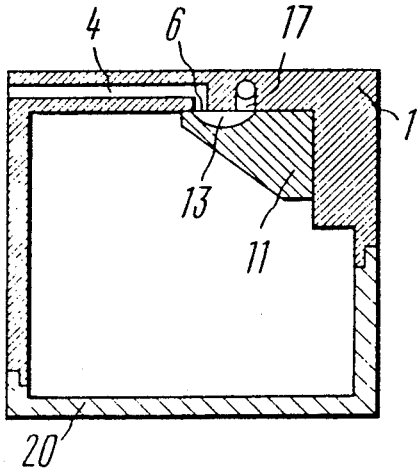
FIG. 4 is a section taken along the line IV—IV in FIG. 2.

The housing 1 has a passage 4 (FIGS. 3 and 4) for feeding compressed air with outlet holes 5 and 6 at the inside surface of the cover plate 3' of the housing 1, and a through passage 7 with an outlet hole 8 also made at the inside surface of the cover plate 3' of the housing 1. Connected to the housing 1 a pneumatic drive 9 (FIGS. 1 and 2) having a pressure cavity 10 communicating with the passage 7 via passage 4 (FIGS. 1 and 3).

The interior of the housing 1 accomodates a slide valve 11 positioned so that its top edge is continuously in contact with the inside surface of the cover plate 3' of the housing having the outlet holes 3, 5, 6 and 8, and is in contact with the wall of the housing 1 only by one side edge. The slide valve 11 is connected to the drive 9 to execute reciprocations along the housing 1. Provided at the upper edge of the slide valve 11 is a volume-calibrated powder-metering cavity in the form of a recess 12 and an additional recess 13. The slide valve 11 is resiliently urged to the housing 1 by a cylindrical helical spring 14.

Figure 5:
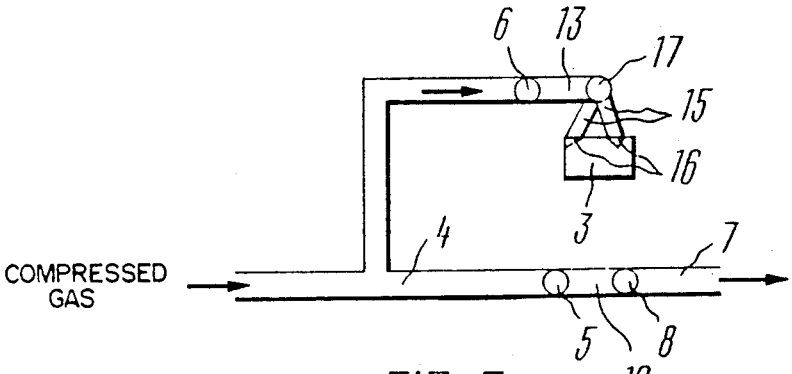
FIG. 5 shows schematically gas lines of the proposed arrangement.

The housing 1 has a through passage 15 (FIG. 2) with a hole 16 letting out into the passage 3 for conveying the powder from the hopper 2, and a hole 17 (FIGS. 4 and 5) made at the inside surface of the cover plate 3' of the housing 1. The passage 15 connects the passage 4 for feeding compressed air through the additional recess 13 with the interior of the hopper 2 in one of the extreme positions of the slide valve 11.

At the side of the outlet hole 8 of the passage 7 the slide valve 11 is rigidly connected to a shut-off unit 18 (FIG. 1), whereas the housing 1 accomodates a wedged ledge 19. The shut-off unit 18 moves together with the slide valve 11 so that in the extreme (left-side as seen in FIG. 1) position its beveled lower face bears on the ledge 19 to form a wedged connection and tightly block the hole 8 (FIG. 3) for feeding the powder to a barrel 19'.

The slide valve 11 can be of any known suitable construction; however, in a preferred embodiment it has the form of a prism, as the most simple and reliable, since the contact with the surface of the housing 1 runs along the top and slide faces of the prism to allow for the travel along the common edge of said faces.

The housing 1 includes a removable tray 20. The passage 7 extends into the barrel 19' of the gas detonation apparatus (FIGS. 2 and 3).

The proposed arrangement operates in the following manner.

Prior to starting operation a powder is charged into the hopper 2. In the initial position the drive 9 acts to set the slide valve 11 to the extreme (left side as seen in FIG. 1) position. The spring 14 forces the slide valve 11 by its upper and side faces to the housing 1, the upper face of the slide 11 blocking the holes 6 and 17, whereas the metering recess 12 is filled with the powder through the hole 3. In this position the shut-off unit 18 bears on the ledge 19 and closes the holes 5 and 8. As the compressed air is admitted to the pressure cavity 10 and passage 4, the drive 9 moves the slide valve 11 with a quantity of powder in a direction from left to right as seen in FIG. 2, and when the slide valve 11 reaches the extreme right position, the quantity of powder is discharged from the recess 12 through the hole 8 and along the passage 7 to the barrel 19' by compressed gas conveyed through the hole 5 of the passage 4 (FIG. 3). At the same time, from the passage 4 via the hole 6 and additional recess 13 the compressed gas flows to the passages 15 to escape at a high velocity through the holes 16 to the interior of the hopper 2 at its base and thereby break bridges of powder formed inside the hopper 2 for the powder to fall on the top face of the slide valve 11. Then the drive 9 returns the slide valve 11 to the initial position which is preset by the wedged ledge 19 restricting the travel of the shut-off unit 18 and consequently of the slide valve 11, whereas the wedged shape of the shut-off unit 18 and the corresponding inclination of the contact surface of the wedged ledge 19 ensure that the force of the drive 9 is converted into closing force, whereby the shut-off unit 18 reliably blocks the hole 8 preventing the breakthrough of the products of detonation from the working zone of the barrel 19' along the passage 7 to the interior of the housing 1 during detonation. In the course of movement of the slide valve 11 the spring 14 ensures reliable pressure and allows displacement of the slide valve 11 from the housing 1 as the grains of powder enter the space therebetween avoiding jamming of the slide valve 11 during its movements.

The service life of the arrangement is increased and the wear of the slide valve 11 is reduced by minimizing the working force of the spring I4. On the other hand, this force must be sufficient for providing reliable pressure of the slide valve 11 to the housing 1 during the movement of the slide valve 11.

Industrial Applicability

The invention can be used in gas detonation units for obtaining heat, corrosion and wear resistant coatings for machine parts operating under conditions of high abrasive wear and in corrosive media.

We claim:

1. Apparatus for feeding powder to the barrel of a gas detonation apparatus comprising a housing (1), a hopper (2) containing the powder and communicating with an interior space of the housing (1), and a slide valve (11) provided inside the housing (1) and having a powder-metering recess (12) and a drive (9) which moves the slide valve from a first extreme position to a second extreme position, the housing (1) having passages (3, 4, 7) for feeding compressed air and for conveying the powder from the hopper (2) to the powder-metering recess (12) and from the powder-metering recess (12) to the barrel (19), said passages having openings (5, 6, 8) in an internal wall of the housing characterized in that the slide valve (11) is positioned in an upper part of the housing (11) and means (14) is provided resiliently urging the slide valve against said wall of the housing having the openings (5, 6, 8) of the passages (3, 4, 7), the powder-metering recess (12) being located at a surface of the slide valve (11) in contact with said wall of the housing (1), a shut-off unit (18) being further provided which is connected to the slide valve (11) and which blocks one of said openings (8) of the passage (7) for conveying the powder from the powder-metering recess (12) to the barrel (19') in the first extreme position of the slide valve (11), and the powder-metering recess in the second extreme position of the slide valve (12) communicates with the opening (8) of the passage (7) for conveying the powder to the barrel (19').

2. Apparatus as claimed in claim 1, characterized in that an additional recess (13) is provided at the surface of the slide valve (11) in contact with the housing (1), the housing (1) having a passage (15) connecting the passage (4) for feeding compressed gas through the additional recess (13) with an interior space of the hopper (2) in one of the extreme positions of the slide valve (11).

3. Apparatus as claimed in claim 1 wherein the housing has a further interior wall perpendicular to said wall having the openings, wherein the slide valve has surfaces engaging both said walls and wherein the means urging the slide valve comprises a spring exerting a force on the slide valve in a direction which is inclined to both said walls whereby components of said force urge the slide valve against both said walls.

* * * * *